US007171751B2

(12) United States Patent
Iwashita et al.

(10) Patent No.: US 7,171,751 B2
(45) Date of Patent: Feb. 6, 2007

(54) ELECTRIC SHAVER

(75) Inventors: Seiji Iwashita, Matsumoto (JP); Akira Hirabayashi, Matsumoto (JP); Yukio Izumi, Matsumoto (JP); Hiromi Uchiyama, Matsumoto (JP)

(73) Assignee: Izumi Products Company, Nagano (JP)

( * ) Notice: Subject to any disclaimer, the term of this patent is extended or adjusted under 35 U.S.C. 154(b) by 0 days.

(21) Appl. No.: 10/447,175

(22) Filed: May 28, 2003

(65) Prior Publication Data

US 2003/0221319 A1 Dec. 4, 2003

(30) Foreign Application Priority Data

May 29, 2002 (JP) ..... 2002-155415

(51) Int. Cl.
*B26B 19/02* (2006.01)

(52) U.S. Cl. ..... 30/43.91; 30/43.92; 30/346.51

(58) Field of Classification Search ..... 30/34.1, 30/43.91, 43.92, 43.7, 43.8, 43.9, 346.51
See application file for complete search history.

(56) References Cited

U.S. PATENT DOCUMENTS

| | | | | |
|---|---|---|---|---|
| 3,863,338 A | | 2/1975 | Wellinger et al. | |
| 4,085,503 A | * | 4/1978 | Beck et al. | 30/34.1 |
| 4,922,608 A | * | 5/1990 | Pahl | 30/43.91 |
| 5,189,792 A | * | 3/1993 | Otsuka et al. | 30/43.92 |
| 5,193,275 A | * | 3/1993 | Hirokazu et al. | 30/43 |
| 5,201,781 A | * | 4/1993 | Jestadt et al. | 30/43.92 |
| 5,410,811 A | | 5/1995 | Wolf et al. | |
| 5,564,191 A | * | 10/1996 | Ozawa | 30/43.92 |
| 5,611,145 A | * | 3/1997 | Wetzel et al. | 30/43.92 |
| 5,678,312 A | | 10/1997 | Watanabe | |
| 6,219,920 B1 | | 4/2001 | Klein | |
| 6,317,984 B1 | * | 11/2001 | Okabe | 30/43.92 |
| 6,688,002 B2 | * | 2/2004 | Momose et al. | 30/43.92 |

FOREIGN PATENT DOCUMENTS

| | | |
|---|---|---|
| EP | 0 721 824 | 7/1996 |
| JP | 09-019574 | 1/1997 |
| JP | 09-173665 | 7/1997 |
| JP | 2000-157760 | 6/2000 |

* cited by examiner

*Primary Examiner*—Timothy V. Eley
*Assistant Examiner*—Omar Flores Sanchez
(74) *Attorney, Agent, or Firm*—Koda & Androlia

(57) ABSTRACT

An electric shaver including first and second oscillators that convert rotational driving, which is supplied from a driving motor via joint portions that are connected to each other in a plurality of locations in the height direction of the shaver, into reciprocating driving that is oriented in mutually opposite directions and transmit this reciprocating driving to cutter units. The first and second oscillators are connected to first and second eccentric pins which are installed in upright at positions where phases are substantially opposite above and below the eccentric joint portions.

8 Claims, 7 Drawing Sheets

ELECTRIC SHAVER

BACKGROUND OF THE INVENTION

1. Field of the Invention

The present invention relates to an electric shaver and more particularly to an electric shaver that has, on the upper portion of the shaver main body, a cutter head in which a plurality of cutter units that have outer cutters and inner cutters that reciprocate while making sliding contact with the outer cutters are installed side by side.

2. Prior Art

In a typical reciprocating electric shaver, a cutter head is installed on the upper portion of a shaver main body that includes a driving source (motor), a driving mechanism, a power supply, an operating switch, etc. The cutter head is comprised of one or more main cutter units and an auxiliary cutter unit, which are installed side by side. Each of the main cutter units comprises a combination of a foil-form outer cutter and an inner cutter that makes a reciprocating motion while making sliding contact with the inside surface of the outer cutter. The auxiliary cutter unit comprises a combination of a slit-form outer cutter (e.g., an edge-trimming cutter or a rough shaving cutter) and an inner cutter that makes a reciprocating motion while making sliding contact with the inside surface of the outer cutter.

In an electric shaver that has a plurality of cutter units in the cutter head, a single oscillator (oscillating member) is connected to an eccentric pin that is eccentrically disposed on a motor joint portion. A plurality of cutter units are supported on this oscillator, and the inner cutters of the respective cutter units are simultaneously caused to make a reciprocating motion. Such electric shavers are described in U.S. Pat. No. 5,410,811 and Japanese Patent Application Laid-Open (Kokai) No. H9-19574.

In the above-described electric shaver, since the shaver is arranged so that the driving force is transmitted to a plurality of cutter units from a single oscillator and thus causing the respective inner cutters to oscillate, the distance over which the driving force is transmitted from the eccentric pin to the inner cutters of the respective cutter units supported on the oscillator tends to increase. As a result, the oscillation amplitude of the cutter units become larger, and the driving efficiency drops.

Furthermore, since the cutter head is supported on the shaver main body so as to allow free pivoting, the length of the groove formed in the oscillator must be increased if the inclination of the oscillator that is groove-engaged with the eccentric pin is taken into account. Accordingly, the external size of the oscillator must be increased, and this causes the size of the cutter head to increase.

SUMMARY OF THE INVENTION

The present invention solves the above-described problems encountered in the prior art.

The object of the present invention is to provide an electric shaver in which the distance over which the driving force is transmitted to a plurality of cutter units in the cutter head that is pivotally disposed on the shaver main body is minimized, so that the oscillation amplitude of the inner cutters is reduced to improve the driving efficiency, and the size of the cutter head is also reduced.

The above object is accomplished by a unique structure for an electric shaver that includes a cutter head which is installed on an upper portion of a shaver main body in a pivotable fashion in a forward-rearward direction and which is provided therein with a plurality of cutter units, each of the cutter units having an outer cutter and an inner cutter that reciprocates while making sliding contact with an inside surface of the outer cutter; and in the present invention, the shaver is provided with a plurality of oscillating members that convert a rotational driving, which is supplied from a driving source inside the shaver main body via joint portions connected in a plurality of locations in a direction of a height of the shaver main body, into a reciprocating drive oriented in mutually opposite directions and transmit the reciprocating driving to the cutter units; and the plurality of oscillating members are connected to a plurality of eccentric pins which are installed in upright at positions where phases are substantially opposite above and below at least one or more eccentric joint portions.

In this structure, the head supporting shafts of the cutter head that is installed on the upper portion of the shaver main body in a pivotable fashion are provided in a height range that is between the uppermost connection part and a lowermost connection part where the oscillating members and eccentric pins are respectively connected above and below the eccentric joint portions.

Preferably, the head supporting shafts are provided in substantially the central portion between the uppermost connection part and the lowermost connection part where the oscillating members and eccentric pins are respectively connected above and below the eccentric joint portions.

DETAILED DESCRIPTION OF THE INVENTION

Preferred embodiments of the present invention will be described in detail below with reference to the accompanying drawings.

Figure 7A:
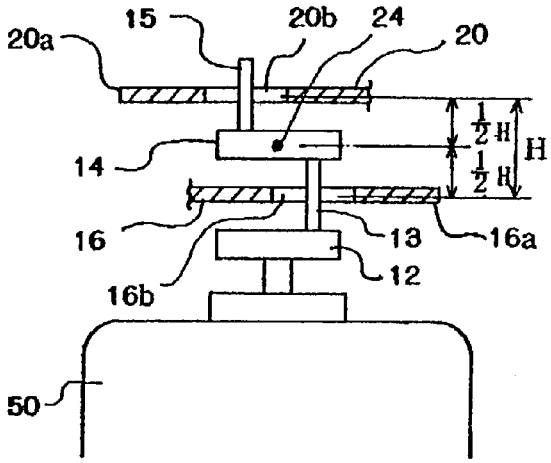
FIGS. 7(*a*) and 7(*b*) are explanatory diagrams which show the positional relationship between the connection parts of the eccentric pins and oscillating members and the head supporting shafts.
Figure 7B:
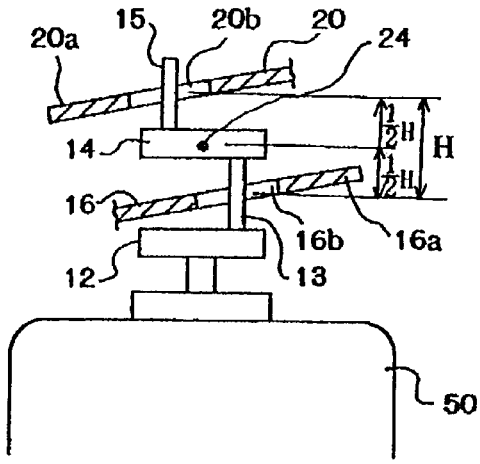

First, the schematic construction of the electric shaver will be described with reference to FIGS. 2(*a*) and 2(*b*) and FIG. 7. A cutter head 2 is installed on the upper portion of a shaver main body 1 so as to be pivotal in the forward and rearward directions. In the cutter head 2, a plurality of cutter units each comprising a combining of an outer cutter and an inner cutter that reciprocates while making sliding contact with the outer cutter are installed side by side. The shaver main body 1 is equipped with a driving source and driving mechanism. The cutter head 2 has a plurality of cutter units as movable units. In use of the shaver, at least one of the cutter units among these movable units is fixed in a position in which the cutter unit has been moved upward or downward from a standard position.

In the shown embodiment, a movable cutter unit 3, which has foil-form outer cutters 3*a*, and an edge-trimming cutter unit 6, which has slit-form outer cutters 6*a*, are provided as movable units. As will be described later, in use, the movable cutter unit 3 or the edge-trimming cutter unit 6 is fixed at a position after the cutter unit is moved upward or downward. The other cutter units, i.e., the main cutter unit 4 which has foil-form outer cutters 4*a* and the rough shaving cutter unit 7 which has slit-form outer cutters 7*a* are used "as is" without being moved upward or downward.

Figure 6:
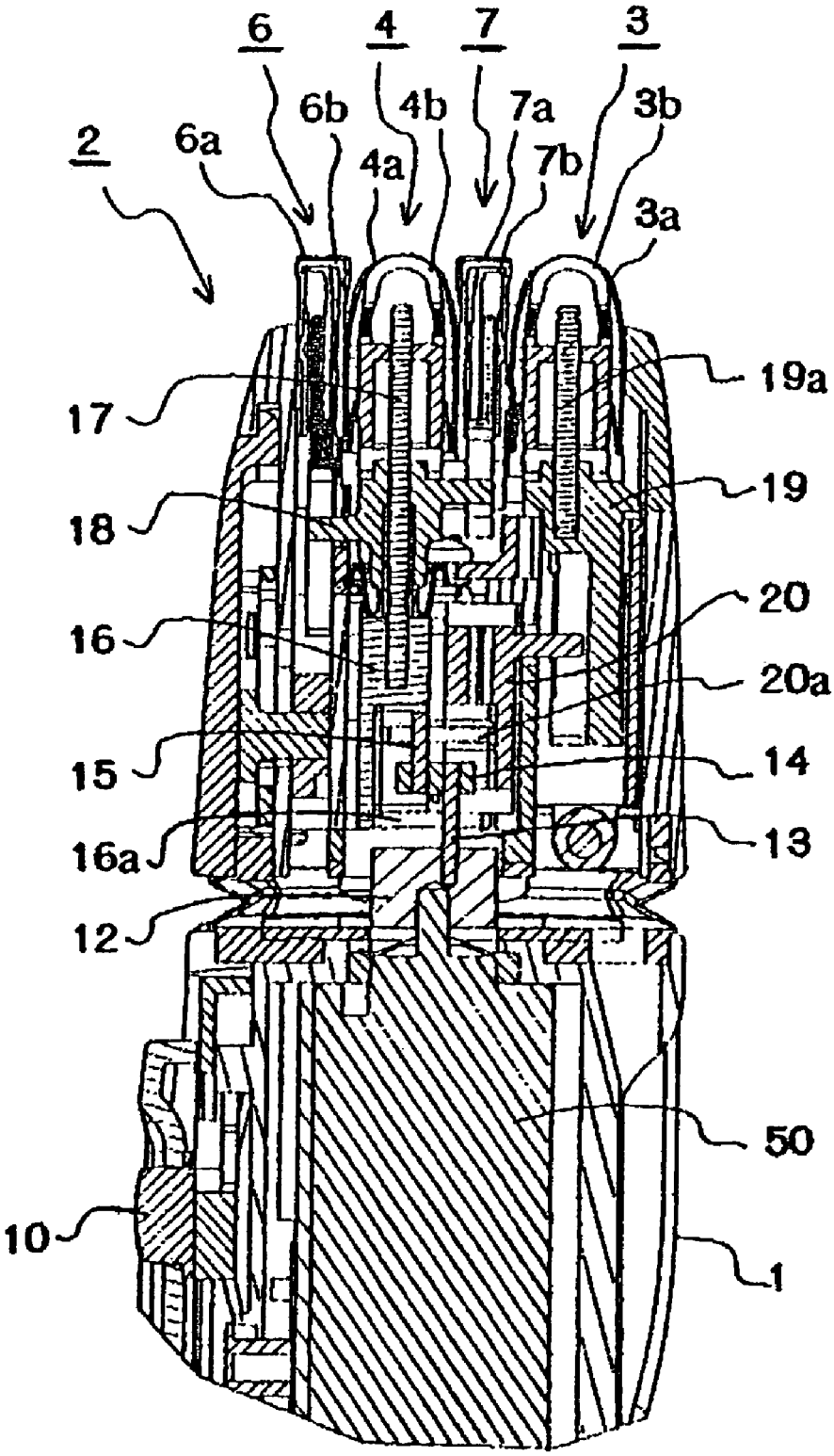
FIG. 6 is a sectional view taken along the line 6—6 in FIG. 4.

As seen from FIG. 6, the edge-trimming cutter unit 6 is mounted on the cutter head frame 5 so as to be adjacent to the main cutter unit 4. The edge-trimming cutter unit 6 includes a slit-form outer cutter 6*a* and an inner cutter 6*b* that makes a reciprocating motion while making sliding contact with the inside surface of the outer cutter 6*a*.

Figure 2A:
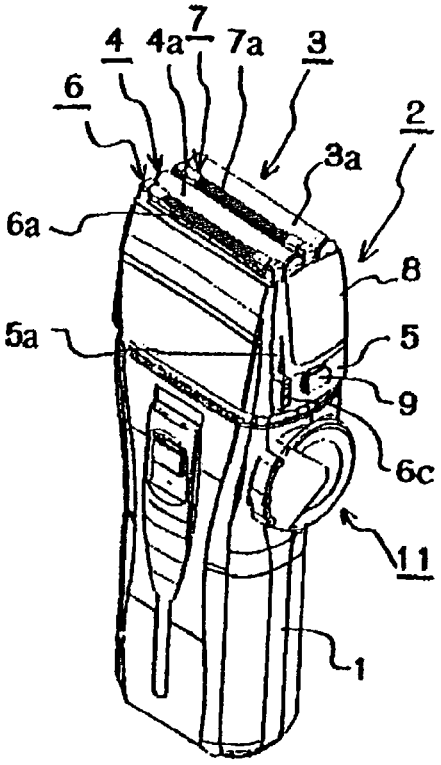
FIGS. 2(*a*) and 2(*b*) show the external perspective views of the electric shaver according to the present invention.
Figure 2B:
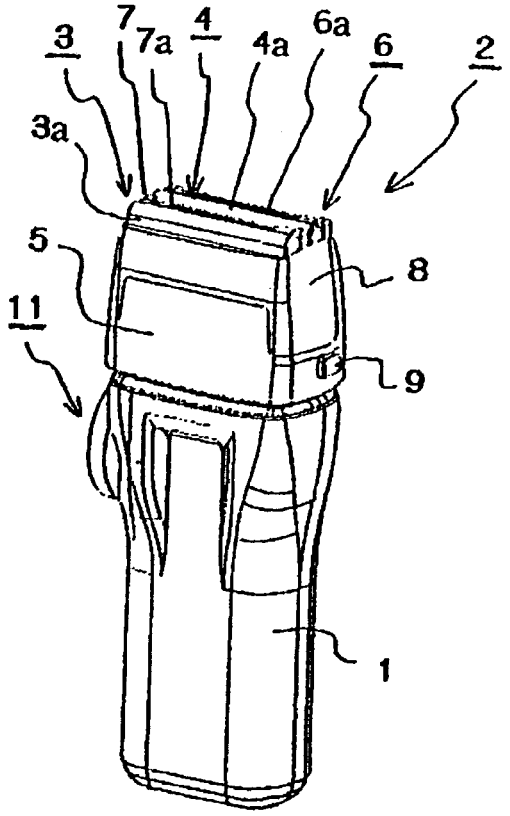

As seen from FIG. 2(*a*), the edge-trimming cutter unit 6 is connected to an operating lever 6*c*. The operating lever 6*c* passes through a guide hole 5*a* formed in the vertical direction in the cutter head frame 5 and protrudes to the outside of the frame. The outside surface of this operating lever 6*c* is knurled, and the cutter surface of the edge-trimming cutter unit 6 is caused to protrude upward for use by catching the fingers on the knurled surface of the operating lever 6*c* and sliding the operating lever 6*c* along the guide hole 5*a*.

As shown in FIG. 6, the rough shaving cutter unit 7 is mounted on the cutter head frame 5 by being installed between the main cutter unit 4 and movable cutter unit 3. The rough shaving cutter unit 7 includes a slit-form outer cutter 7*a* and an inner cutter 7*b* that make a reciprocating motion while making sliding contact with the inside surface of the outer cutter 7*a*. The rough shaving cutter unit 7 is used mainly for shaving long whiskers or unmanageable whiskers. After rough shaving has been performed with this rough shaving cutter unit 7, finishing shaving is performed by the movable cutter unit 3 or the main cutter unit 4. The movable cutter unit 3 and main cutter unit 4 are respectively equipped with foil-form outer cutters 3*a* and 4*a* and inner cutters 3*b* and 4*b* that reciprocate while making sliding contact with the inside surfaces of the outer cutters 3*a* and 4*a*.

As seen from FIGS. 2(*a*) and 2(*b*), the outer cutter 4*a* of the main cutter unit 4, the rough shaving cutter unit 7 and the outer cutters 3*a* of the movable cutter unit 3 are supported on an outer cutter frame 8. The outer cutter frame 8, as shown in FIG. 3, can be separated from the cutter head 2 by means of an outer cutter frame detachment key 9 installed on the cutter head 2.

Figure 3:
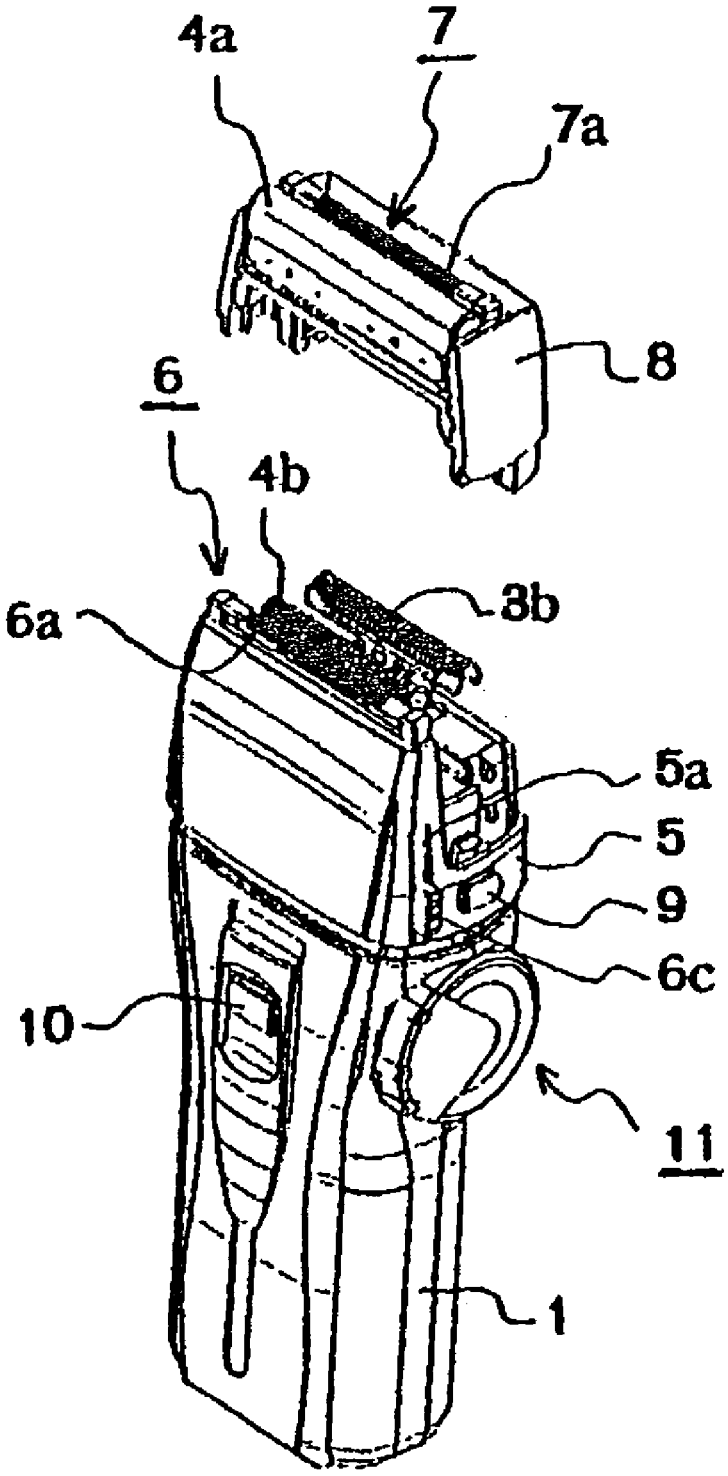
FIG. 3 is an exploded perspective view of the electric shaver according to the present invention.

Furthermore, as seen from FIG. 3, a main switch 10 is disposed on the front face of the shaver main body 1. With the operation of the main switch 10, the inner cutters installed in the movable cutter unit 3 and in the main cutter unit 4 are driven to reciprocate. Moreover, a mode-switching dial 11, which is one example of a mode-switching section, is provided on one side face of the shaver main body 1. By way of rotating the mode-switching dial 11 in a specified direction, the movable cutter unit 3 is moved upward or downward from a standard position, and the angle of inclination of the cutter head 2 with respect to the shaver main body 1 is varied, as will be described later.

Figure 4:
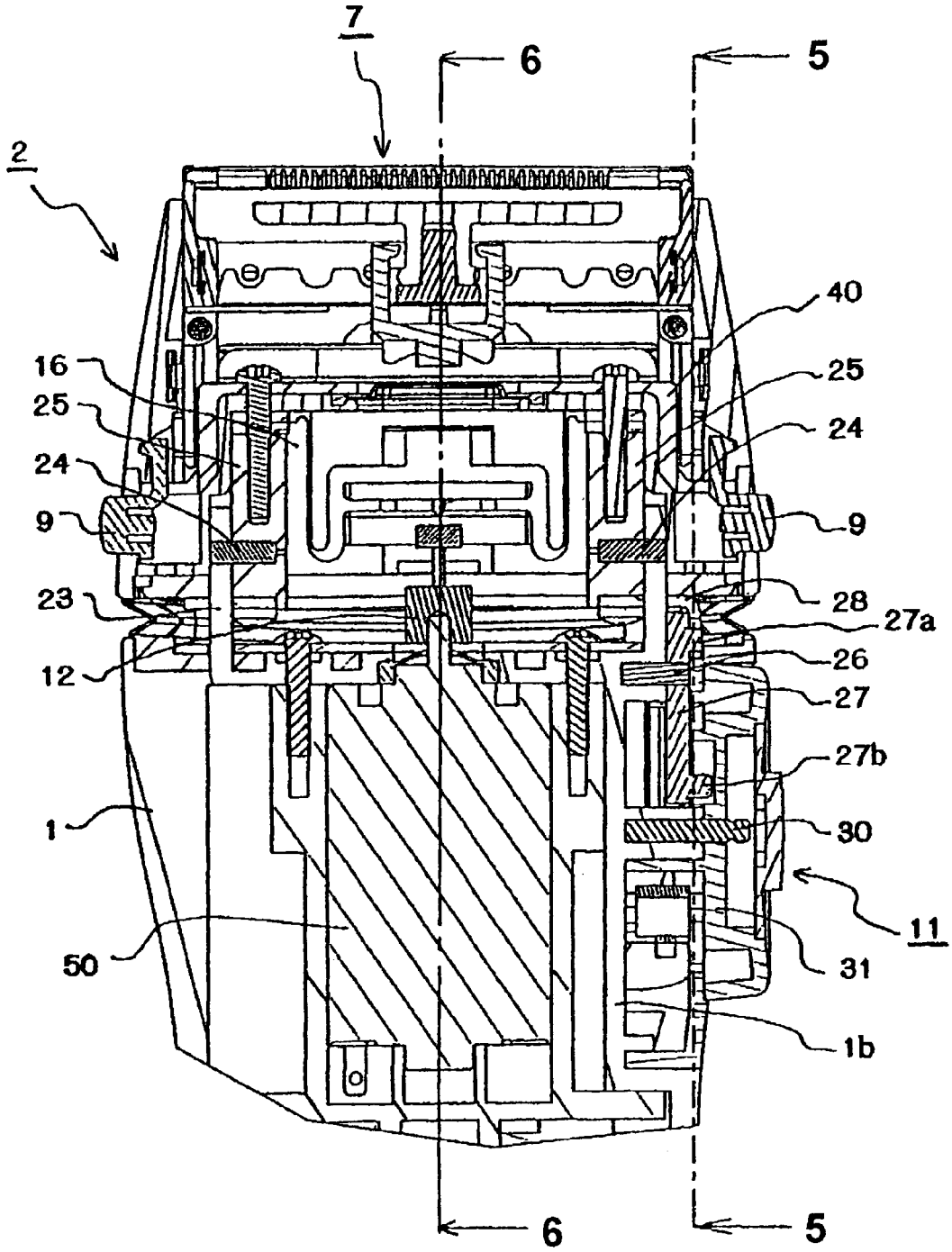
FIG. 4 is an enlarged sectional view of a part of the central portion of the electric shaver according to the present invention the electric shaver.

In FIG. 4, the head supporting shafts 24 are inserted into projecting parts 23 which are installed on the left and right sides on the upper surface part of the shaver main body 1. Furthermore, both sides of a head base part 25 that is built into the bottom part of the cutter head 2 are fit over the head supporting shafts 24. The cutter head 2 is supported so that this cutter head 2 can pivot in the forward-rearward direction about the head supporting shafts 24 with respect to the shaver main body 1. First and second oscillators (described later) are superimposed on a head cover 40 and screw-fastened to the head base part 25.

Next, the construction of the respective elements of the electric shaver will be described with reference to FIGS. 4 through 6.

In FIG. 6, a first motor joint portion 12, a first eccentric pin 13, a second motor joint portion 14 and a second eccentric pin 15 are installed on the upper surface of the shaver main body 1 so that these elements are connected in the axial direction. The second motor joint portion 14 is an eccentric joint portion that is connected via the first eccentric pin 13. The first and second eccentric pins 13 and 15 are installed upright at positions whose phases are substantially opposite above and below the second motor joint portion 14.

The inner cutter 4*b* of the main cutter unit 4 is connected to the oscillator shaft 17 of a first oscillator (or a first oscillating member) 16. The oscillator connecting portion 16*a* of the first oscillator 16 is groove-engaged with the first eccentric pin 13. A cutter connecting body 18 is engaged with the oscillator shaft 17. This cutter connecting body 18 is connected to the edge-trimming cutter unit 6 and rough shaving cutter unit 7. The inner cutter 3*b* of the movable cutter unit 3 is connected to the movable oscillator shaft 19*a* of a movable oscillator (or a third oscillating member) 19. Furthermore, the movable oscillator 19 is connected to a second oscillator (or a second oscillating member) 20 so that the movable oscillator 19 is movable upward and downward with respect to the second oscillator 20. In other words, the movable oscillator 19 is installed so that its movement in the vertical direction is free and only movement in the horizontal direction is restricted, thus preventing any interference with the second oscillator 20 even if the movable cutter unit 3 is moved upward and downward. The oscillator connecting portion 20*a* of the second oscillator 20 is groove-engaged with the second eccentric pin 15. The first oscillator 16 and the second oscillator 20 change the rotational driving of the driving motor 50 into an oscillation driving, thus driving the inner cutters of the above-described cutter units.

The first eccentric pin 13 and second eccentric pin 15 are installed upright at positions whose phases are substantially opposite above and below the second motor joint portion 14. The first oscillator 16 is connected to the first eccentric pin 13, and the second oscillator 20 is connected to the second eccentric pin 15. As a result, the rotational driving of the second motor joint portion 14 is converted into mutually opposite reciprocating motions by the first oscillator 16 and second oscillator 20 and is transmitted to the inner cutters of the respective cutter units.

When the driving motor 50 is started, the rotational driving is transmitted to the main cutter unit 4, edge-trimming cutter unit 6 and rough shaving cutter unit 7 via the first oscillator 16 and also is transmitted in the opposite directions to the movable cutter unit 3 via the second oscillator 20 and movable oscillator 19. In this case, the respective inner cutters 4*b*, 6*b* and 7*b* of the main cutter unit 4, edge-trimming cutter unit 6 and rough shaving cutter unit 7 and the inner cutters 3*b* of the movable cutter unit 3 are driven in a reciprocating motion in mutually opposite directions.

Thus, as a result of the transmission of the driving to the first and second oscillators 16 and 20 from the first and second eccentric pins 13 and 15 installed above and below the second motor joint portion 14, so that the distance over which the driving is transmitted to the plurality of cutter units of the cutter head 2 that is supported on the shaver main body 1 so that this cutter head 2 can pivot is minimized, the oscillation amplitude of the inner cutters can be reduced, so that the driving efficiency can be improved.

Furthermore, in FIG. 4, the mode-switching dial 11 is fit over a dial shaft 30 on one side face 1*b* of the shaver main body 1 so that the dial can rotate about the dial shaft 30. A head connecting body 27 is disposed on this side face 1*b* so that this head connecting body 27 can rotate about a connecting body supporting shaft 26.

Figure 5:
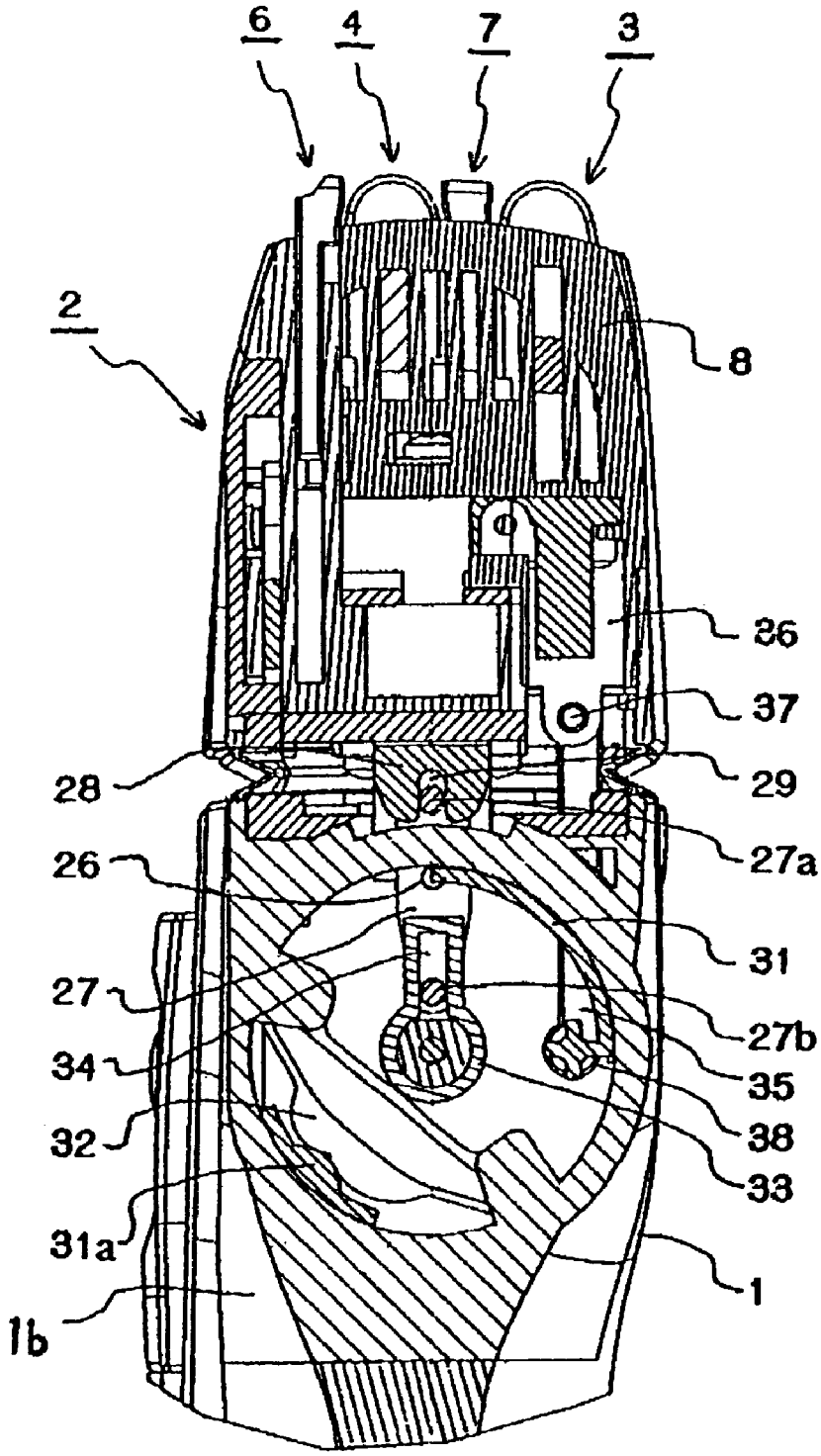
FIG. 5 is a sectional view taken along the line 5—5 in FIG. 4.

In FIG. 5, an engaging pin 27*a* on one end of the head connecting body 27 is fit into a recessed groove 29 formed in a reinforcing plate 28 which is disposed on the bottom part of the cutter head 2. Furthermore, an engaging pint 27*b* on the other end of the head connecting body 27 is connected to the mode key 31 of the mode-switching dial 11. A rib 33 is formed around the engagement hole by which the mode key 31 is engaged with the dial shaft 30. An engaging groove 34 that is surrounded by this rib 33 is disposed in the direction of diameter. The engaging pin 27*b* on the other end of the head connecting body 27 is fit into the engaging groove 34.

Furthermore, one end of a link arm 35 is connected to the arm shaft 37 of an oscillator holder 36 which is disposed in the bottom part of the movable cutter unit 3, and the other end of this link arm 35 is connected to a boss part 38 installed on the mode key 31. When the mode-switching dial 11 is turned, the oscillator holder 36 is pushed upward or pulled downward via the link arm 35, so that the movable cutter unit 3 can be moved upward or downward.

The position of the mode-switching dial 11 is arranged so that the shaver can be used with the dial position (position of the movable cutter unit 3) fixed by the engagement of the mode key clicking body 32 and the clicking portion 31*a* of the mode key 31, the mode key clicking body 32 and the mode key 31 being provided on the side face 1*b* of the shaver main body 1. In the shown embodiment, as will be described later, the electric shaver is designed so that mode-switching can be performed among three positions: a normal mode (for use on the cheeks), an under-the-nose mode (for use under the nose), and an under-the-jaw mode (for use under the jaw). As a result, as will be described later, the movable cutter unit 3 can be respectively moved to a normal position, upper position or lower position and fixed in these positions.

Next, the mechanism that varies the angle of inclination of the cutter head 2 with respect to the shaver main body 1 when the movable cutter unit 3 is moved to a predetermined position in the vertical direction form the standard position will be described with reference to FIGS. 1(*a*) through 1(*c*). The angle of inclination of the cutter head 2 will be described with the vertical direction taken as an angle of zero degrees.

Figure 1C:
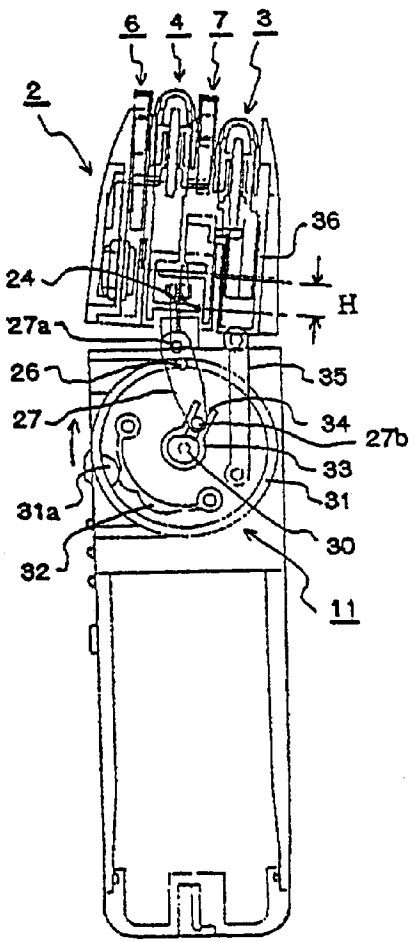
FIGS. 1(*a*) through 1(*c*) are explanatory diagrams showing the inside of the cutter head of the electric shaver according to the present invention in different operating modes.
Figure 1B:
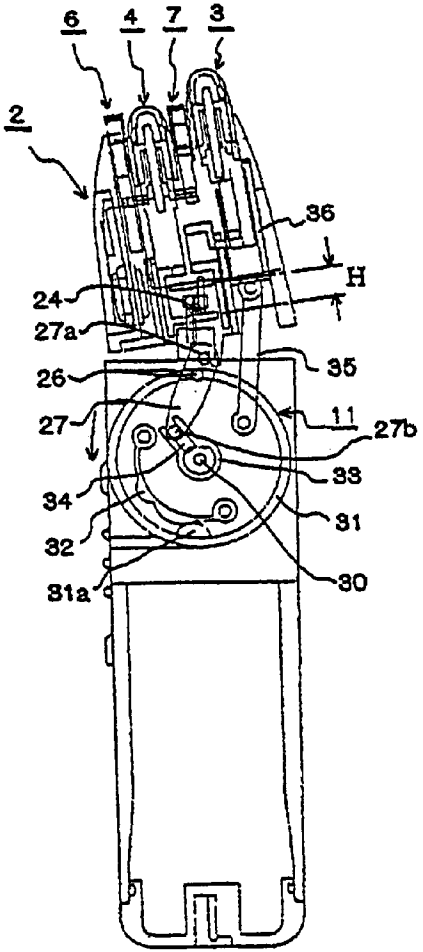
Figure 1A:
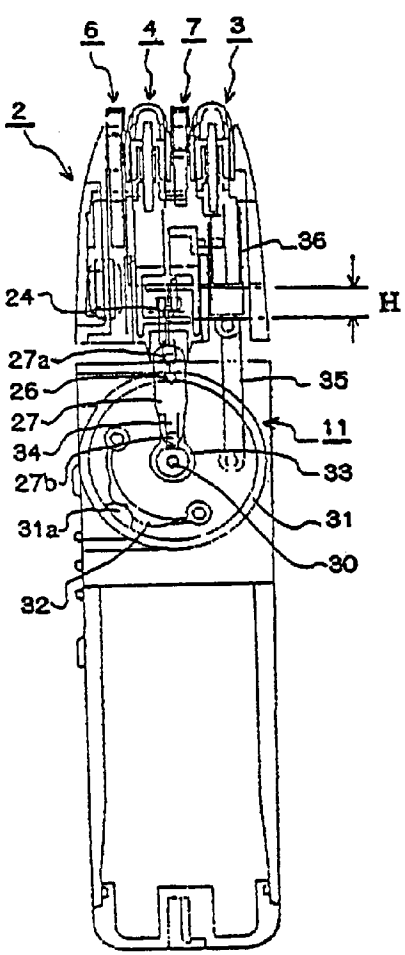

FIG. 1(*a*) shows a state in which the movable cutter unit 3 is in the standard position (normal mode). In this case, the link arm 35 connects the mode key 31 and oscillator holder 37 in an attitude that is parallel to the vertical direction. The angle of inclination of the cutter head 2 is maintained at zero degrees.

FIG. 1(*b*) shows a state in which the mode-switching dial 11 is rotated in the counterclockwise direction, so that the mode key 31 is rotated in the same direction, thus effecting positioning by engagement of the clicking portion 31*a* with the mode key clicking body 32 (under-the-nose mode). In this case, the movable cutter unit 3 is pushed upward by the link arm 35 and held in a height position where the movable cutter unit 3 protrudes further than the other cutter units of the cutter head 2. On the other hand, when the mode key 31 is rotated in the counterclockwise direction, the rib 33 also is rotated in the same direction, so that the engaging pin 27*b* of the head connecting body 27 that is connected to the engaging groove 34 is moved outward in the direction of diameter along the engaging groove 34. In this case, the head connecting body 27 is rotated slightly in the clockwise direction about the connecting body supporting shaft 26. As a result, the reinforcing plate 28 (see FIG. 5) to which the engaging pin 27*a* of the head connecting body 27 is connected is caused to swing in the counterclockwise direction, so that the shaver is used while held in a state in which the cutter head 2 has been rotated in the counterclockwise direction about the head supporting shafts 24. The angle of inclination of the cutter head 2 in this case is approximately 8.1 degrees, and the cutter head 2 is inclined slightly to the left with respect to the shaver main body 1.

FIG. 1(*c*) shows a state in which the mode-switching dial 11 is rotated in the clockwise direction, so that the mode key 31 is rotated in the same direction, thus effecting positioning by engagement of the clicking portion 31*a* with the mode key clicking body 32 (under-the-jaw mode). In this case, the movable cutter unit 3 is pulled downward by the link arm 35 and held in a height position where the movable cutter unit 3 is retracted further than the other cutter units of the cutter head 2. On the other hand, when the mode key 31 is rotated in the clockwise direction, the rib 33 is also rotated in the same direction, so that the engaging pin 27*b* of the head connecting body 27 connected to the engaging groove 34 is moved slightly outward in the direction of diameter along the engaging groove 34. In this case, the head connecting body 27 is rotated slightly in the counterclockwise direction about connecting body supporting shaft 26. As a result, the reinforcing plate 28 (see FIG. 5) to which the engaging pin 27*a* of the head connecting body 27 is connected is caused to swing in the clockwise direction, so that the shaver is used while held in a state in which the cutter head 2 has been rotated in the clockwise direction about the head supporting shafts 24. The angle of inclination of the cutter head 2 in this case is approximately 5 degrees, so that the cutter head 2 is inclined slightly to the right with respect to the shaver main body 1.

In all of the above-described modes, the head supporting shafts 24 of the cutter head 2 supported on the upper portion of the shaver main body 1 are installed within a height range H between the lowermost first connection part where the first oscillator 16 and first eccentric pin 13 are connected, and the uppermost second connection part where the second oscillator 20 and second eccentric pin 15 are connected, above and below the second motor joint portion 14. It is even more desirable that the head supporting shafts 24 be installed in substantially the central portion of the height range H between the above-described first connection part and second connection part as shown in FIGS. 7(*a*) and 7(*b*).

As a result, though the cutter head 2 pivots about the head supporting shafts 24, the distance to the first and second connection parts to which the driving is transmitted from the second motor joint portion 14 can be shortened; accordingly, the length of the grooves 16*b* and 20*b* that are respectively formed in the oscillator connecting parts 16*a* and 20*a* of the first and second oscillators 16 and 20 can be set short. Consequently, the size of the first and second oscillators 16 and 20 is reduced, and the size of the cutter head 2 can be reduced.

Figure 8A:
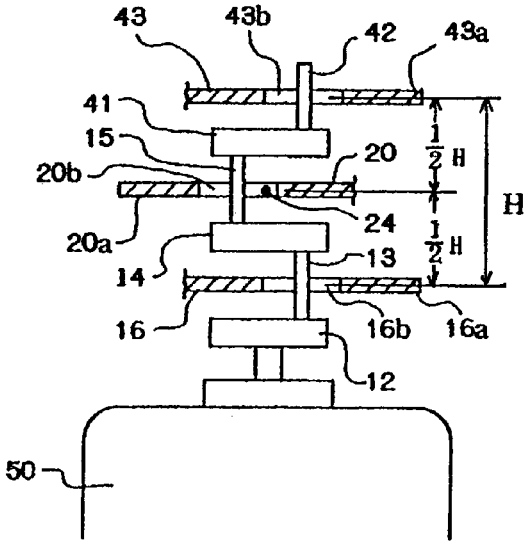
FIGS. 8(*a*) and 8(*b*) are explanatory diagrams which show the positional relationship between the connection parts of the eccentric pins and oscillating members and the head supporting shafts in another example.
Figure 8B:
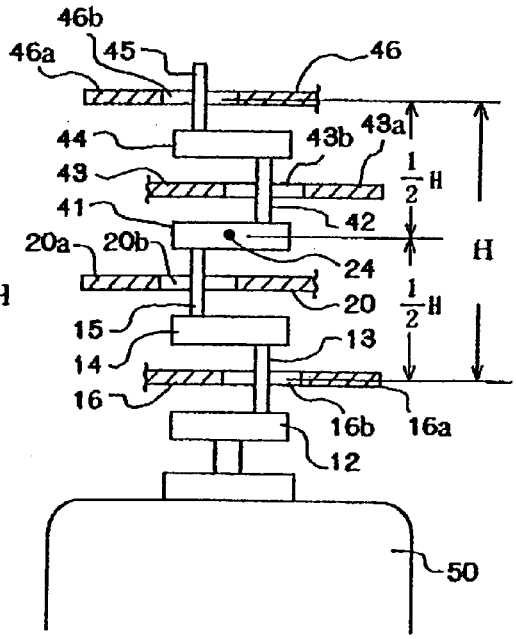

Preferred embodiments of the present invention are described above. However, the present invention is not limited to the electric shaver described above. For example, as shown in FIG. 8(*a*), a third motor joint portion (eccentric joint) 41 can be connected on top of the second eccentric pin 15, and a third eccentric pin 42 can be installed upright in a position whose phase is substantially opposite from that of the second eccentric pin 15 on top of this third motor joint portion 41. Furthermore, a third oscillator 43 can be connected to the third eccentric pin 42 by means of a groove 43*b* formed in an oscillator connecting part 43*a*.

Alternatively, as shown in FIG. 8(*b*), a fourth motor joint portion (eccentric joint) 44 can be connected on top of the third eccentric pin 42, and a fourth eccentric pin 45 can be installed upright in a position whose phase is substantially opposite from that of the third eccentric pin 42 on top of the fourth motor joint portion 44. Furthermore, a fourth oscillator 46 can be connected to the third eccentric pin 42 by means of a groove 46*b* formed in an oscillator connecting part 46*a*.

By thus connecting a plurality of eccentric joint portions and eccentric pins in the axial direction (height direction), it is possible to cause an even larger number of cutter units to perform reciprocating motions in mutually opposite directions. In such cases as well, it is desirable that the head supporting shafts 24 of the cutter head 2 be installed in the height range H between the upper most connection part and lowermost connection part where the oscillators and eccentric pins are connected above and below the eccentric joint portions, and preferably in substantially the central portion (H/2) between the uppermost connection part and lowermost connection part.

Furthermore, instead of a single movable cutter unit 3, the movable cutter unit 3 can be installed in a plural numbers; and by way of increasing combinations with the main cutter unit 4, so that the shaver can be used with diverse variations in the height of the cutter surfaces.

Furthermore, the arrangement of the movable cutter unit 3 and main cutter unit 4 that include foil-form outer cutters, and the arrangement of the edge-trimming cutter unit 6 and rough shaving cutter unit 7 that include slit-form outer cutters, are optional. These cutter units can be alternately disposed, and the edge-trimming cutter unit 6 and rough shaving cutter unit 7 can be disposed on both sides of the movable cutter unit 3 and main cutter unit 4.

In addition, the mode-switching section is not limited to a dial system; and the height positions of the cutter surfaces can be switched using some other type of system such as a lever system, etc. Thus, many modifications can be made within limits that involve no departure from the spirit of the invention.

In the electric shaver of the present invention, the shaver is provided with a plurality of oscillating members that convert a rotational driving, which is supplied from a driving source inside the shaver main body via joint portions connected in a plurality of locations in a direction of a height of the shaver main body, into a reciprocating driving oriented in mutually opposite directions and transmit the reciprocating driving to the cutter units; and the plurality of oscillating members are connected to a plurality of eccentric pins which are installed in upright at positions where phases are substantially opposite above and below at least one or more eccentric joint portions.

Accordingly, the distance over which the reciprocating driving is transmitted to the plurality of cutter units of the cutter head that is supported on the shaver main body so that the cutter head pivots can be minimized so that the oscillation amplitude of the respective inner cutters can be reduced, thus improving the driving efficiency.

Furthermore, the head supporting shafts of the cutter head that is installed on the upper portion of the shaver main body in a pivotable fashion are provided in a height range between an uppermost connection part and a lowermost connection part where the oscillating members and eccentric pins are respectively connected above and below the eccentric joint portions. Preferably, the head supporting shafts are provided in substantially a central portion between the uppermost connection part and the lowermost connection part where the oscillating members and eccentric pins are respectively connected above and below the eccentric joint portions. Accordingly, the length of the grooves formed in the plurality of oscillating members can be short; and the size of the respective oscillating members can be reduced; and thus, it is possible to minimize the size of the cutter head.

The invention claimed is:

1. An electric shaver comprising a cutter head pivotally provided on an upper portion of a shaver main body so as to pivot in a forward-rearward direction on said shaver main body and which is provided therein with a plurality of cutter units, each of said cutter units having an outer cutter and an inner cutter that reciprocates while making sliding contact with an inside surface of said outer cutter and means operable by a user for manually and selectively pivoting said cutter bead in said forward-rearward direction to a plurality of predetermined angles of inclination, wherein said shaver is provided with a plurality of oscillating members that convert a rotational driving, which is supplied from a driving source inside said shaver main body via a plurality of motor joint portions connected in a plurality of locations in a direction of a height of said shaver main body by a plurality of eccentric pins, into a reciprocating driving oriented in mutually opposite directions and transmit said reciprocating driving oriented in mutually opposite directions to said cutter units; and wherein said plurality of oscillating members are connected to said plurality of eccentric pins which are installed upright at positions whose phases are substantially opposite and said plurality of eccentric pins are provided above and below at least one of said plurality of motor joint portions; whereby the distance over which a driving force from the driving source is transmitted to a plurality of cutter units in a cutter head that is pivotally disposed on the shaver main body is minimized so as to improve driving efficiency and reduce cutter head size.

2. The electric shaver according to claim 1, wherein head supporting shafts of said cutter head that is installed on said upper portion of said shaver main body in a pivotable fashion are provided in a height range between an uppermost connection part and a lowermost connection part where said oscillating members and eccentric pins are respectively connected above and below said at least one of said plurality of motor joint portions.

3. The electric shaver according to claim 2, wherein said head supporting shafts are provided in substantially a central portion between said uppermost connection part and said lowermost connection part where said oscillating members and eccentric pins are respectively connected above and below said at least one of said plurality of motor joint portions.

4. The electric shaver according to claim 1, wherein at least three of said plurality of motor joint portions are provided, and one of said plurality of eccentric pins are provided on each of said three of said plurality of motor joint portions.

5. The electric shaver according to claim 1, wherein at least four of said plurality of motor joint portions are provided and one of said plurality of eccentric pins are provided on each of said four of said plurality of motor joint portions.

6. The electric shaver according to claim 2, wherein said cutter head is manually pivoted about a longitudinal axis located adjacent a bottom portion of said cutter head.

7. The electric shaver according to claim 5, wherein there are provided four oscillating members and four cutting units.

8. The electric shaver according to claim 1, wherein the means operable by a user for manually and selectively pivoting said cutter head comprises:

a mode-switching dial provided on said shaver main body; and a linkage provided between said mode switching dial and said cutter head for selectively pivoting said cutter head in response to rotation of said mode-switching dial.

* * * * *